US007082619B1

(12) United States Patent
Thompson

(10) Patent No.: US 7,082,619 B1
(45) Date of Patent: Aug. 1, 2006

(54) BILL ADJUSTER WITH INDICIA

(76) Inventor: Roger G. Thompson, 11965 Danforth St., Sterling Heights, MI (US) 48312

( * ) Notice: Subject to any disclaimer, the term of this patent is extended or adjusted under 35 U.S.C. 154(b) by 150 days.

(21) Appl. No.: 10/770,137

(22) Filed: Feb. 2, 2004

(51) Int. Cl.
*A42C 1/06* (2006.01)

(52) U.S. Cl. ..... 2/175.5; 223/14

(58) Field of Classification Search ..... 2/195.6, 2/195.2, 181.4, 209.12, 175.1, 175.2, 175.5, 2/175.6, 195.1; 223/7, 12, 14, 24
See application file for complete search history.

(56) References Cited

U.S. PATENT DOCUMENTS 4,560,166 A * 12/1985 Emerson ..... 473/209
4,607,769 A * 8/1986 DeLisle et al. ..... 223/12
5,012,531 A 5/1991 Schoonover
5,167,559 A * 12/1992 Power-Fardy ..... 446/27
5,276,985 A * 1/1994 Halloran ..... 40/329
5,778,448 A 7/1998 Maher
5,862,522 A 1/1999 Cho
5,908,146 A 6/1999 Levin
5,991,927 A 11/1999 Barbaccia
6,170,088 B1 * 1/2001 Tate ..... 2/209.13
6,315,175 B1 11/2001 Berger
6,510,972 B1 1/2003 Briskey
6,655,558 B1 * 12/2003 Lawrence ..... 223/14
2002/0073478 A1 * 6/2002 James ..... 2/195.5

* cited by examiner

*Primary Examiner*—Danny Worrell
(74) *Attorney, Agent, or Firm*—Ronald R Kilponen

(57) ABSTRACT

A device for adjusting and securing the bill of a cap in a user chosen arc having indicia on the top surface.

16 Claims, 8 Drawing Sheets

BILL ADJUSTER WITH INDICIA

FIELD

The present version of this invention relates generally to the field of adjusters for the arc of bills on caps having indicia for a favorite team, player or for a customized saying.

BACKGROUND

This invention relates to adjusters for the bills of caps having indicia, and more particularly to a device that will allow the user to adjust the bill of a cap to a user determined arc having indicia showing a favorite team, player or other saying or statement.

Base ball caps and other caps with bills are big sellers. Many users like to have a particular arc or angle to the cap bill. Some users use curved items such as a coffee mug or softball with a rubber band to "fix" the bill of the cap to that desired arc. The bill of the cap may not hold the user desired arc of the bill or the arc of the bill may change if the bill becomes wet from rain, snow or perspiration. A specific arc of the bill may be needed to block the sun or for many other reasons. The background art does not provide a suitable method to obtain and maintain that desired arc of the bill along with providing a space for indicia. These embodiments provide a user adjustable arc to the bill where the arc of the bill and indicia can be moved from one billed cap to another billed cap. The indicia can either be permanently applied to the device or customized by the user.

Many users desire to promote a specific team or product or show their support for a particular player, or dislike of a particular team or player, or have a custom message that can be displayed on a cap bill. It is desirable to have the message or indicia on the cap bill be interchangeable depending on whom the user is supporting or depending on which type of event the cap wearer is attending. The user likewise wishes to obtain the "optimum" arc of the bill while having the changeable indicia on the bill.

For the foregoing reasons, there is a need for a cap bill adjuster with changeable indicia.

SUMMARY

In view of the foregoing disadvantages inherent in the background art there is a need for a cap bill adjuster with changeable indicia.

A first object of the invention is to provide a device that allows the user to customize and maintain the arc of the bill of a cap.

Another object of the invention is to provide a device that will allow the user to adjust the arc of the cap bill depending on the wearers activities and desired arc of the bill.

It is yet another object of the invention to provide a device that will allow the user to have indicia on the bill of the cap and retain the desired arc of the cap bill.

It is a still further object of the invention to provide a device that will allow the user to change the indicia on the bill of the cap and retain the desired arc of the cap bill.

These together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DETAILED DESCRIPTION OF THE PREFERRED EMBODIMENTS

Figure 1:
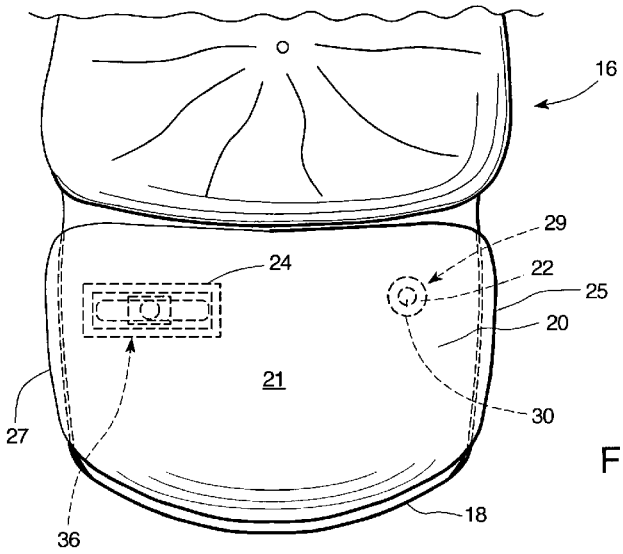
FIG. 1 shows a top view of one embodiment of the invention attached to the bill of a cap.

Referring to the drawings in detail wherein like elements are indicated by like numerals, there is shown in FIG. 1 a cap 16 having an attached bill 18 with a top side and an underside. A bottom surface 21 of a bill adjuster 20 is located adjacent to the top side of the bill 18. The bill adjuster 20 has a top surface 21 and bottom surface 23 which approximate the shape of the cap bill 18, FIGS. 1 & 2. Although the embodiments shown approximate the shape of the cap 16 bill 18, alternative shapes to the bill adjuster 20 as shown in FIG. 14 and others are anticipated.

Figure 2:
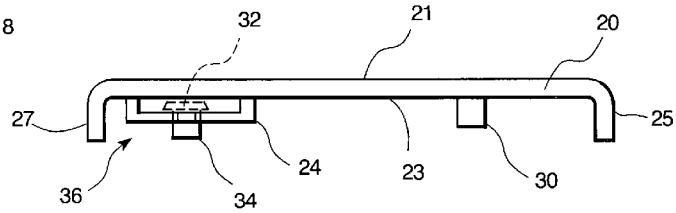
FIG. 2 shows a front edge view of one embodiment of the bill adjuster.
Figure 3:
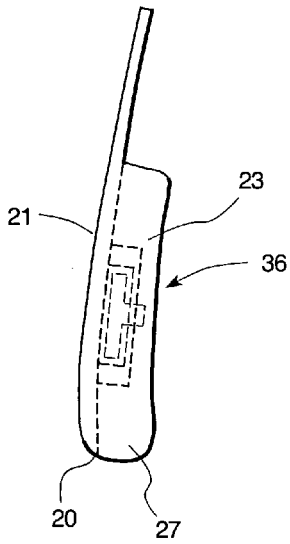
FIG. 3 shows an end view of one embodiment of the bill adjuster.

The bill adjuster 20 has a first side 25 and second side 27, FIG. 2. Other embodiments of the bill adjuster 20 could be produced without the first and second sides 25, 27 and the bill adjuster 20 could be of a planar shape approximating the shape of the cap bill 18, not shown. The bill adjuster 20 is preferably manufactured from a polymer, but could be manufactured from aluminum or thin steel.

This embodiment of the bill adjuster 20 has a male snap 30 near the first side 25 and a adjustable snap 36 near the second side 27, FIG. 2. Both the male snap 30 and adjustable snap 36 are located on the bottom surface 23 of the bill adjuster 20. The male snap 30 and adjustable snap 36 are preferably manufactured from a polymer. The male snap 30 can be molded to the bottom surface 23 or attached with adhesive.

Figure 7:
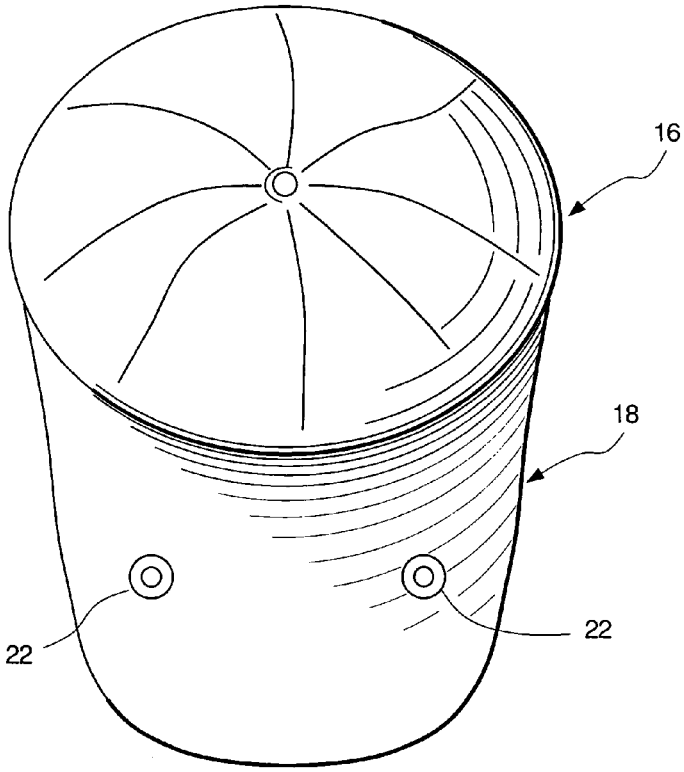
FIG. 7 shows a top view of one embodiment of the cap and bill with bill snaps.
Figure 8:
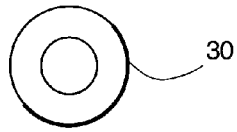
FIG. 8 shows a bottom view of one embodiment of the male snap.
Figure 9:
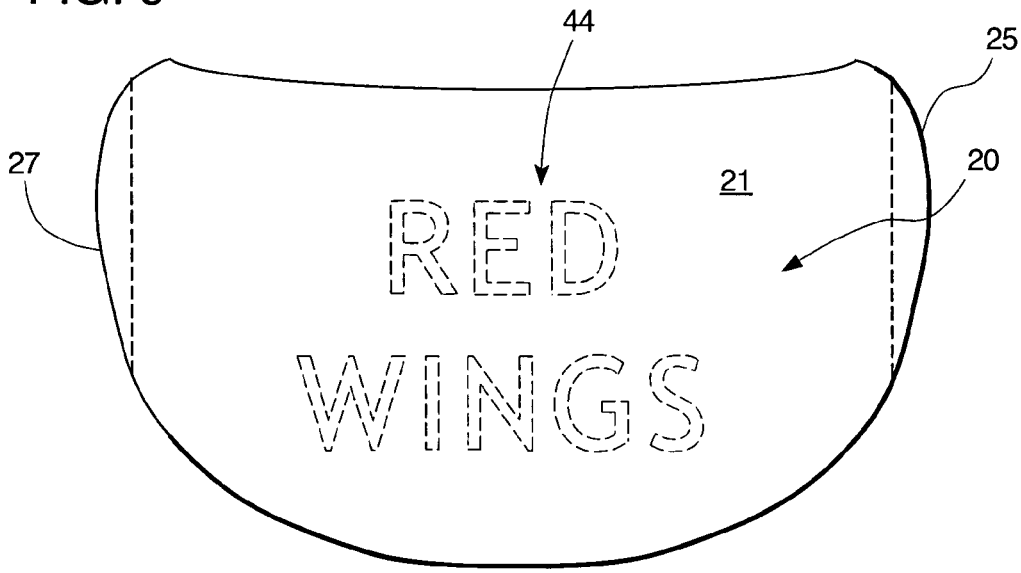
FIG. 9 shows a top view of one embodiment of the bill adjuster with representative indicia.

The fixed snap 29, FIG. 1, consists of a male snap 30 portion having a corresponding bill snap 22 female portion affixed to the bill 18, FIG. 7. The adjustable snap 36 has a threaded cap 34 male portion and corresponding bill snap 22 female portion on the bill 18, FIG. 7. The adjustable snap 36 is slidingly adjustable in the first side 25 direction and the second side 27 direction.

Figure 4:
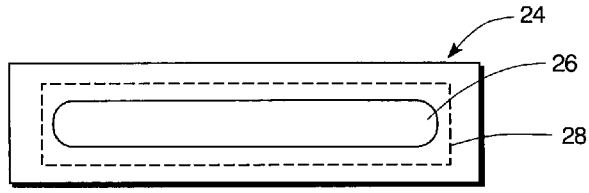
FIG. 4 shows a bottom view of one embodiment of the adjustment housing.
Figure 4A:
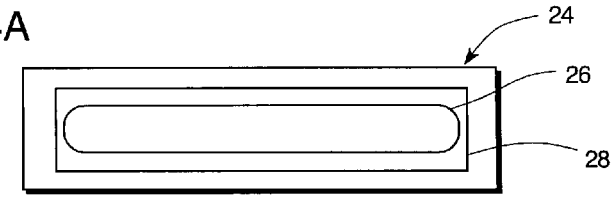
FIG. 4A shows top view of one embodiment of the adjustment housing.
Figure 5:
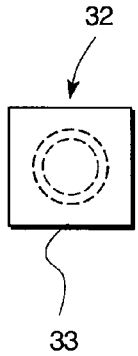
FIG. 5 shows a top view of one embodiment of the threaded slider.
Figure 5A:
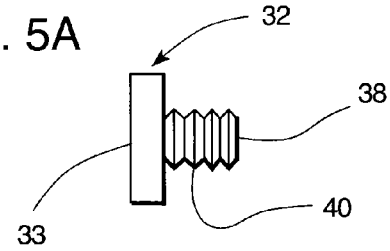
FIG. 5A shows a side view of one embodiment of the threaded slider.
Figure 6:
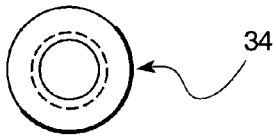
FIG. 6 shows a top view of one embodiment of the threaded cap.
Figure 6A:
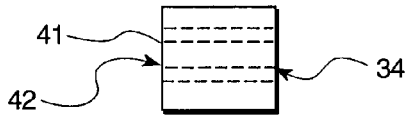
FIG. 6A shows a side view of one embodiment of the threaded cap.

This adjustment is provided by the adjustment housing 24 which has a slot 26 and a shelf 28, FIGS. 4, 4A. The adjustable snap 36 has a threaded slider 32 and a corresponding threaded cap 34, FIGS. 5, 5A, 6, 6A. The threaded slider 32 has a rectangular base 33 which corresponds in size to the shelf 28 such that the base 33 of the threaded slider 32 can slide within the shelf 28 of the adjustment housing 24. The threaded cap 34 is attached to the stem 38 of the threaded slider 32. The threaded cap 34 once installed on the stem 38 is inserted into the bill snap 22 closest to the second side 27 to secure the bill adjuster 20 to the bill 18. The adjustment housing 24 can be attached to the bottom surface 23 with an adhesive.

The stem 38 of the threaded slider 32 is inserted through the slot 26 of the adjustment housing 24. The adjustment housing 24 is then secured to the bottom surface 23 of the bill adjuster 20. The base 33 of the threaded slider 32 can then translate within the shelf 28 of the adjustment housing 24. To secure the threaded slider 32 relative to the adjustment housing 24 requires that the threaded cap 34 be screwed onto the stem 38 of the threaded slider 32. When the threaded cap 34 is turned towards the adjustment housing 24, the end 41 abuts the adjustment housing 24 securing the threaded slider 32 and threaded cap 34 relative to the adjustment housing 24, FIG. 2. The threaded cap 34 is sized such that it can be inserted into and secured by the female bill snap 22 nearest the second side 27.

When the male snap 30 is secured into the bill snap 22 nearest the first side 25 of the bill adjuster 20 and the threaded cap 34 is secured into the bill snap 22 nearest the second side 27 of the bill adjuster 20, the bill adjuster is secured to the bill 18 of the cap 16. Loosening the threaded cap 34 relative to the threaded slider 32 allows the base 33 to slide within the shelf 28 relative to the adjustment housing 24. This allows the distance between the fixed snap 29 and the adjustable snap 36 to be changed. If the distance between the fixed snap 30 and the adjustable snap 36 is changed and these elements are then re-attached to the respective bill snaps 22, the arc of the bill 18 can be adjusted by the user. The user can customize the arc of the bill 18 depending on the needs and desires of the user.

Figure 10:
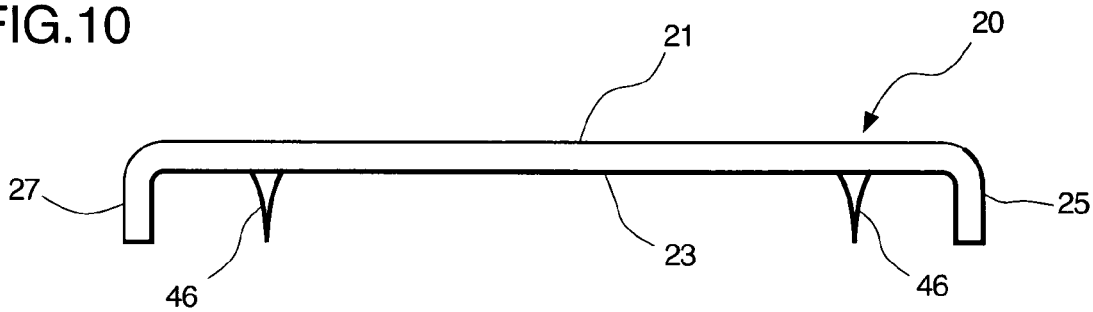
FIG. 10 shows a front edge view of another embodiment of the bill adjuster.
Figure 11:
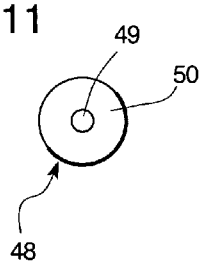
FIG. 11 shows a top view of one embodiment of a retainer.
Figure 12:
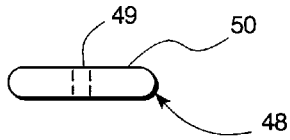
FIG. 12 shows a side view of one embodiment of a retainer.
Figure 13:
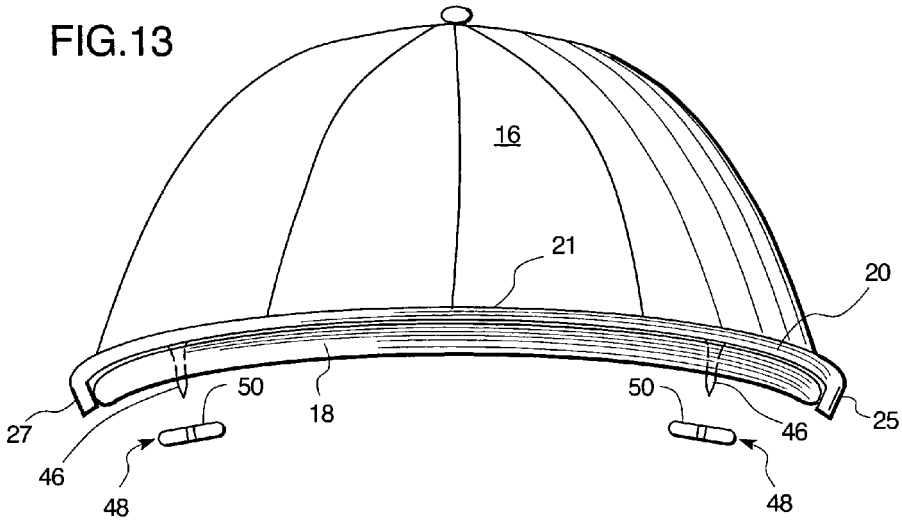
FIG. 13 shows a front edge view of one embodiment of the bill adjuster attached to a bill of a cap.
Figure 14A:
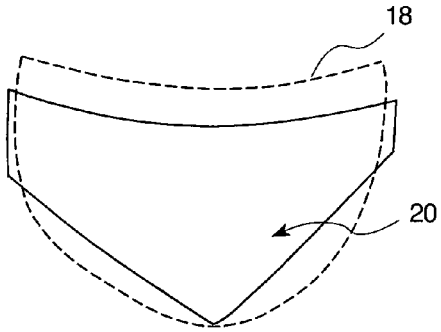
FIG. 14 shows a top view of some alternative shapes to the bill adjuster.
Figure 14B:
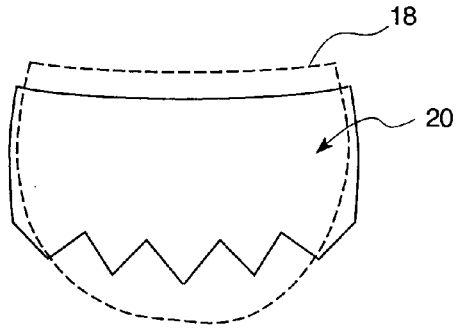
Figure 14C:
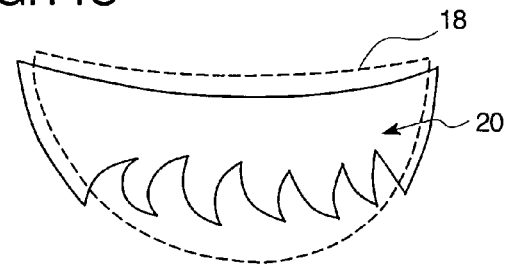
Figure 14D:
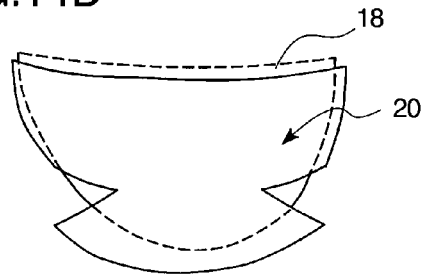

FIGS. 10 & 13 show another embodiment of the bill adjuster 20. This embodiment of the bill adjuster 20 has a top surface 21, bottom surface 23, first side 25 and second side 27. In a preferred embodiment the bill adjuster 20 is made from a polymer material. This embodiment has a pair of spikes 46, one located near the first side 25 and the second spike 46 located near the second side 27. The spikes 46 are preferably made from a polymer material that is strong enough to penetrate the bill 18 and can be molded with the bill adjuster 20. Alternatively, the spikes 46 can be made from a steel material and molded into the bill adjuster 20. This embodiment of the bill adjuster 20 can be attached to the bill 18 by pressing the spikes 46 through the bill 18 and placing the hole 49 of the retainer 48 onto the spikes 46 and securing the base 50 of the retainers 48 against the bottom of the bill 18, FIGS. 1, 12, 13. The retainers 48 in a preferred embodiment are made from a polymer material and the hole 49 is sized to secure the spikes 46 with a friction fit. The retainers 48 will thus secure the bill adjuster 20 to the bill 18 providing an optimum user chosen arc of the bill 18. By placing the spikes 46 through the bill 18 at different locations allows the arc of bill 18 to be adjusted.

This embodiment can be used on different caps 16 that the user may own, or can be moved from cap 16 to another cap 16. Likewise, this embodiment of the bill adjuster 20 has indicia on the top surface. This indicia 44, not shown, can either be permanently affixed to the top surface or can be removable or replaceable.

Another embodiment of the bill adjuster 20 shown in FIG. 10 can be made without the first side 25 and second side 27 such that the bill adjuster is a planar design of approximately the same shape as the bill 18. Although the embodiments of the bill adjuster 20 shown approximate the shape of the cap 16 bill 18, alternative shapes to the bill adjuster 20 as shown in FIG. 14 and others are anticipated. The embodiments shown in FIG. 14 are meant to be illustrative and not limitations.

Figure 15:
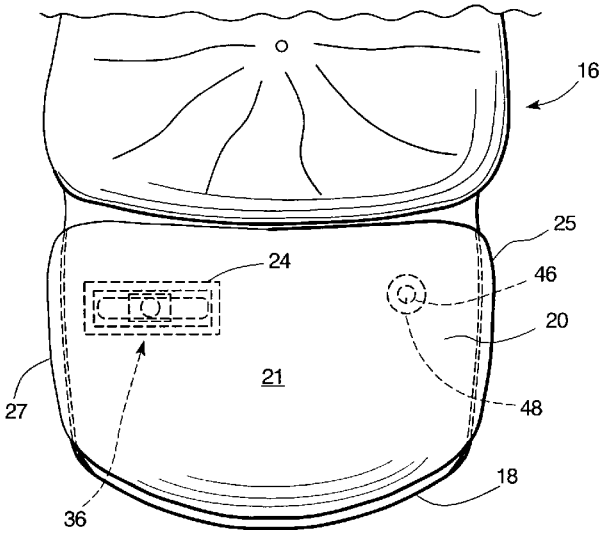
FIG. 15 shows a top view of another embodiment of the invention attached to the bill of a cap.
Figure 16:
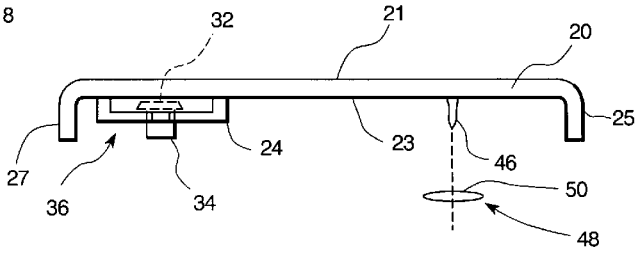
FIG. 16 shows a front edge view of another embodiment of the bill adjuster attached to the bill of a cap.

FIGS. 15 and 16 show another embodiment of the invention having an adjustable snap 36 near the second side and a spike 46 near the first side 25. The adjustable snap 36 is attached to the bill 18 with a bill snap 22, FIG. 7, and the spike 46 is attached to the bill 18 with a retainer 48 as shown in FIG. 16. Although the embodiments of the bill adjuster 20 shown approximate the shape of the cap 16 bill 18, alternative shapes to the bill adjuster 20 as shown in FIG. 14 and others are anticipated. The embodiments shown in FIG. 14 are meant to be illustrative and not limitations.

It is anticipated that other methods of attachment of the bill adjuster 20 to the bill 18 could be used such as hook and loop fasteners, adhesives and sewing, not shown.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A device for customizing the arc of a bill on a cap, the device comprising:

a bill adjuster having a top surface, a bottom surface, a first side and a second side;

a male snap attached to the bottom surface near the first side;

an adjustable snap attached to the bottom surface near the second side;

the adjustable snap comprising a housing, a threaded slider and a threaded cap, whereby the threaded slider is translatable in a shelf of the housing and fixable by rotating the threaded cap such that an end of the threaded cap contacts the housing between the end of the threaded cap and the base of the threaded slider thereby retaining the threaded slider and threaded cap relative to the housing;

two bill snaps attached to the bill corresponding in size to the male snap and threaded cap and for securing the male snap and threaded cap to the bill; and the top surface of the bill adjuster having indicia.

2. The device of claim 1, further comprising:

the indicia is changeable.

3. The device of claim 1, further comprising:

the indicia is permanently affixed.

4. The device of claim 1, further comprising:

the housing is attached to the bottom surface with an adhesive.

5. The device of claim 1, further comprising:

the male snap is attached to the bottom surface with an adhesive.

6. The device of claim 1, further comprising:

the male snap is molded into the bill adjuster.

7. The device of claim 1, further comprising:

the bill snaps are attached to the bill with an adhesive.

8. A device for customizing the arc of a bill on a cap, the device comprising:

a bill adjuster having a top surface, a bottom surface, a first side and a second side;

a spike attached to the bottom surface near the first side;

an adjustable snap comprising a housing, a threaded slider and a threaded cap;

a retainer for securing the first side of the bill adjuster to the bill of the cap, the retainer having a base and a hole;

a bill snap attached to the bill corresponding in size to the threaded cap for securing the threaded cap and bill adjuster to the bill near the second side;

the top surface of the bill adjuster having indicia; and whereby, the threaded slider is translatable in the shelf of the housing and fixable by rotating the threaded caps such that an end of the threaded cap contacts the housing between the end of the threaded cap and the base of the slider thereby retaining the threaded slider and threaded cap relative to the housing.

9. The device of claim 8, further comprising:

the indicia is changeable.

10. The device of claim 8, further comprising the indicia is permanently affixed.

11. The device of claim 8, further comprising the housing is attached to the bottom surface with an adhesive.

12. The device of claim 8, further comprising the bill snap is attached to the bill with an adhesive.

13. The device of claim 8, further comprising the spike is made from a polymer and molded into the bill adjuster.

14. The device of claim 8, further comprising the spike is made from steel and molded into the bill adjuster.

15. The device of claim 8, further comprising the retainer is made from a polymer.

16. The device of claim 8, further comprising the retainer is made from steel.

* * * * *